United States Patent [19]

Hundstad

[11] 4,008,081

[45] Feb. 15, 1977

[54] METHOD OF MAKING VACUUM INTERRUPTER CONTACT MATERIALS

[75] Inventor: Richard L. Hundstad, Forest Hills Borough, Pa.

[73] Assignee: Westinghouse Electric Corporation, Pittsburgh, Pa.

[22] Filed: June 24, 1975

[21] Appl. No.: 589,979

[52] U.S. Cl. ..... 75/135; 75/153; 75/173 R; 164/97

[51] Int. Cl.[2] ..... C22C 1/02

[58] Field of Search ..... 75/135, 153, 173 R; 200/266; 164/97

[56] References Cited

UNITED STATES PATENTS

| | | | |
|---|---|---|---|
| 2,025,662 | 12/1935 | Hensel et al. | 75/153 |
| 2,033,709 | 3/1936 | Hensel et al. | 75/153 |
| 3,082,521 | 3/1963 | Cohen | 75/173 R X |
| 3,330,653 | 7/1967 | Paces et al. | 75/153 |
| 3,788,839 | 1/1974 | Faunce | 75/135 X |

*Primary Examiner*—L. Dewayne Rutledge
*Assistant Examiner*—E. L. Weise
*Attorney, Agent, or Firm*—R. T. Randig

[57] ABSTRACT

A method is described for forming contacts which find use in vacuum interrupters. The method comprises making melt of a first metal having a high electrical conductivity and adding to the melt a second metal having a melting point in excess of the first metal and solubility in the first metal of less than 1 percent at the temperature to which the first metal is heated, intermixing the components to a uniform consistency casting the components to the desired configuration and thereafter cooling to room temperature.

8 Claims, No Drawings

METHOD OF MAKING VACUUM INTERRUPTER CONTACT MATERIALS

BACKGROUND OF THE INVENTION

1. Field of the Invention

The present invention relates to vacuum interrupters, that is, electrical circuit interrupting devices comprising a pair of cooperating contacts in an evacuated enclosure, the contacts being relatively movable between closed and open positions to complete or interrupt an electric power circuit under normal load current and fault conditions. More specifically, the invention relates to the manufacture of contact materials which find use in such vacuum interrupter devices.

2. Description of the Prior Art

In vacuum interrupters, the ambient conditions under which arcing occurs between the contacts when they are separated to interrupt current and the mechanism of arc extinction in vacuum interrupters, is somewhat different from the mechanism of arc extinction in other types of circuit interrupters in which the arcing occurs in a medium such as insulating oil or gas. Consequently, the tendency for the contacts to weld together when operated in the vacuum is much more severe. Therefore, the choice of contact materials for other types of circuit interrupters and related devices such as spark gaps is not relevant to the choice of contact materials for vacuum interrupters.

Heretofore, refractory metals such as tungsten, molybdenum and their carbides have been successfully used for the contacts of vacuum interrupters of relatively low current interrupting capability. In particular, such contacts are characterized by porous matrix of refractory metal particles metallurgically bonded together usually comprising a sintered compact of interrupting particles and the interstices of the matrix are infiltrated with a high conductivity metal usually copper which characterically possesses a lower melting and boiling point as well as higher electrical and thermal conductivities than that of the matrix material. Such refractory metal matrix provides high mechanical strength and good erosion resistance. Moreover, the matrix metal has little tendency to weld and being of low ductility also maintains smooth contact surfaces and consequently high open circuit dielectric strengths. The presence of the infiltrant reduces the current chopping level which is excessively high in contacts made of refractory metals. The current interrupting ability of vacuum interrupters having contacts of such infiltrated refractory matrix materials is limited however because of excessive thermionic emission from the refractory constituent at high currents.

One of the solutions posed to these problems resulted in the development of vacuum interrupters of higher current interrupting capability and departed from the use of infiltrated matrix contact materials. This solution involved the use of alloys in which a major constituent metal is alloyed with a minor constituent the latter of which forms brittle films at the grain boundries between the crystals of the major constituent. Typical of such alloys is the composition represented by the copper-bismuth system. With this alloy material, the excessive thermionic emission associated with refractory metals is avoided and the effects excessive weld tendency and ductility of the high conductivity metals are relieved by what has been termed intercrystalline weaknesses. With these intercrystalline weaknesses, intercontact welds are easily broken without drawing spikes from the contact surfaces during circuit interruption.

Moreover, the intercrystalline weakness makes the contacts mechanically inferior to those contacts employing the infiltrated matrix material of low ductility. Consequently, since they are mechanically weak throughout the structure, the material does not have the ability of the matrix material to retain contact profile during operation. As a result, separation of the contact material tends to rupture intercrystalline boundries both near the original interface and further into the body of the material. This mechanical weakness also places many limitations on the mechanical design of the contacts, which ideally is determined by the plasma physics of the arc.

Another solution proposed to alleviate these problems involved the utilization of the better parts of the two previous solutions. This solution involves making the contact materials from parts which constituted a porous matrix of metal particles, metallurgically bonded together, and in which the interstices of the matrix material are infiltrated with another metal of lower melting and boiling points and high electrical and thermal conductivies. The matrix material usually comprising particles of a low conductivity but fairly high melting point metal, that is, the metal had a melting point higher than the high conductivity metal which was used as the infiltrant and which forms a precipitation alloy component with the infiltrated metal but does not otherwise form any degree of alloys having solid solubility of the one metal in the other. As a result, in the surface region of the contacts which are melted by arcing, the precipitation alloy forms and on subsequent cooling recrystallizes to reestablish the infiltrated matrix structure with the particles of the sintered matrix structure remaining intact throughout the arc operation.

Typically, these contacts were made by sintering particles of a metal having a high melting point, such as for example chromium and infiltrating the same with copper or silver so as to form a unitary structure. Thus, when copper and chromium are used, the matrix chromium metal is soluble to a substantial extent in the copper metal, when the latter is liquid and heated to a sufficiently high temperature, but the solid solubility is quite low usually being of the order of less than 1 percent.

During operation, a precipitation alloy component will be formed in the contact surface region and the surface structure will be refined and improved as a result of reprecipitation on subsequent cooling. It has been found, however, that when such contact materials are utilized in high current vacuum interrupters, the interruption performance becomes markedly improved with high power testing. Examination of the contact surfaces of chromium-copper contacts materials reveals that the surface becomes altered due to excessive arcing and melting when the interrupter passes several current zeros before interruption. It has been found, however, that this melting and alteration of the metallic structure does not appear to degrade the interruption performance but in fact appears to enhance its performance.

As a result, one of the usual techniques employed with the utilization of these chromium copper contact materials evolved a rather lengthly and costly seasoning procedure in which the contact materials are employed and utilized in a number of high current interruptions in order to season the contact surface.

The method of the present invention utilizes a different method of manufacturing said contact materials and as a result it has been found that the heretofore found necessary seasoning procedure of such contact materials can be virtually eliminated and the materials embodied into a vacuum interrupter without prior high current power testing and seasoning procedures being involved.

SUMMARY OF THE INVENTION

The present invention is directed to the method of making contact materials in which one metal is in the molten state and a second metal in the solid state is added thereto the difference in the melting points being such that the second metal having the higher melting point has limited solubility within the molten first metal and upon the intimate mixing of the components to obtain a uniform consistency, the same is cast into the desired configuration and thereafter cooled to room temperature. For want of a better term this may be referred to as a "mud pie" technique for forming contact materials. More particularly, the method envisages making a melt of a first metal having a high electrical conductivity and adding to the melt a second metal having a melting point in excess of the first metal. The second metal must also have a solubility of less than about 1 percent in the first metal at the temperature to which the first metal is heated. But thereafter, the liquid metal and solid metal are intermixed to obtain a uniform consistency at which time the entire contents are cast into a predetermined configuration of the desired finished contact material. The casting is thereafter cooled to room temperature and may be utilized directly in a vacuum interrupter without extensive high current seasoning which has been found necessary when the same materials are formed into a contact material employing the well known process of sintering and infiltrating.

DESCRIPTION OF THE PREFERRED EMBODIMENT

The method of the present invention is directed to the production of contact materials which find a use in circuit interrupters which operate in a vacuum environment which of necessity requires that the material have significantly different characteristics from the same contact materials operating in oil or in an insulator such as sulfur hexafluoride. Two of the primary considerations involved in the selection of such contact material are the ability to have little or no outgassing during operation, or stated conversely to have little or no occluded gases and said metals must also be characterized by a suitable current chopping level when utilized within the vacuum environment so that the arc may be readily extinguished during circuit interruption.

The choice of materials as indicated previously have involved a number of compositions the most notable of which are the copper-bismuth class on the one hand and the refractory metal-high electrical conductivity metal on the other hand. In contrast thereto, the applicant's invention is directed to the production of contact materials in which the metal of high conductivity is selected from the group of copper, copper base alloys, silver and silver based alloys which provide not only a high electrical conductivity but also a high thermal conductivity which are necessary when these materials are utilized in the harsh environment of a vacuum. The contact material also comprises a second metal having a higher melting point than that of the first metal and preferably the second metal is selected from the group consisting of chromium, vanadium, beryllium and manganese. These materials are admixed in the proper proportions and cast to the desired shape as will be more fully described.

Essentially, the present method involves the melting of the high conductivity material and preferably copper is utilized as the material which is employed in this regard. While copper base alloys can be employed, the alloying components with the copper being derived for the individual benefits known and to be utilized within the copper alloy technology, nonetheless, the metal must be of a high conductivity both electrically and thermally. The copper is melted usually within a vacuum environment and temperatures within the normal melting range of copper are usually employed, that is a temperature not in excess of about 1200° C.

A predetermined mass of copper in any suitable form is thus placed within a crucible and the entire contents thereof are sealed within a vacuum chamber. This may be most expeditiously done by charging the copper into a crucible which is thereafter placed within an induction heating source. At the same time, but in a separate container, the second metal is placed and also sealed within and subjected to the vacuum emvironment.

While the copper can take practically any physical form raging from fine powder to a gross bulk material of a unitary mass it is preferred to have the second metal partake of the dimensions which are desired within the finished compounded contact material. In this respect while the latter action or reaction between the first metal and the second metal may serve to refine the particle size through the phenomenon of precipitation, nonetheless, it is preferred to have the second metal partake of a finely divided physical form and in this respect it is preferred to have the particle size of the second metal be of a dimension of less than 500 microns in diameter. Since there is a limited solid solubility between the second metal and the first metal and since there will actually be a physical intermixing of a liquid phase with a solid component with only a limited amount of reaction between the solid component and the liquid phase, it is preferred to maintain the particle size of the second metal which forms the solid component at less than 500 microns and good results have been obtained where the particle size, for example chromium at about 250 microns in diameter.

In order to minimize the amount of outgassing during operation of the finished contact material a gettering metal can also be charged within the vacuum environment so as to reduce the amount of gases which may ultimately be occluded in the finished product. In this respect it has been found that zirconium in finely divided form will act as an excellent gettering material in compounding the components which formulate the contact material which is the subject of the present invention.

After all of the components are placed within the vacuum environment and a vacuum is drawn usually of less than about $1 \times 10^{-5}$ millimeters of mercury, the induction coil is energized and the temperature of the copper is raised to the point where it becomes molten. In this respect it has been found that a graphite crucible, which graphite also acts as a susceptor during the induction heating, is quite effective providing the graphite is covered with a suitable refractory so as to prevent any reaction between the second metal and the crucible material. After the first metal of high conductivity is within the molten state and at a temperature of between about 1100° C and 1200° C for copper, a predetermined amount of the second metal is added thereto and the contents of the crucible are intermixed to a uniformed consistency. It will be appreciated that with utilizing the second metal which has a melting point substantially in excess of that of the first metal, little reaction occurs between the contents of the crucible.

It is also imperative that mechanical agitation occur so that there is a complete and intimate intermixing of the two metals to provide the contents of the crucible with a uniform consistency. In this respect it has been found that the uniform consistency may be more advantageously achieved where a metal such as zirconium is employed in an amount of less than about 1 percent. The zirconium will function in a two fold respect, that is it will preferentially unite with any oxygen and other gases present in the atmosphere as well as reduce any oxygen that may be contained on the surface of the chromium or other second metal. By providing the latter function that is reducing the oxygen from the surface of the second metal, the zirconium will preferentially act as a wetting agent and thereby improve the intermixing of the two components so that the second metal will be uniformly distributed within the first metal and together a mixture having a uniform consistency will thereby be obtained.

After a suitable intermixing of the components and the attainment of a uniform distribution of the solid component within the molten first metal component, the contents of the crucible are thereafter cast or formed into the desired configuration. This may be accomplished by physically emptying the contents of the crucible into a mold having a configuration of the desired contact material. Accordingly, while the mold is subject to the vacuum environment, it can also be placed in the ambient atmosphere since the amount of oxidation or other gas absorption will be minimized so long as the contents of the crucible are uniformly intermixed into a uniform consistency. Thereafter the contents are cooled to room temperature and the contact material is thereafter removed from the mold in which it has solidified to the desired configuration. At this particular junction, well known finishing operations may take place on the contact material, such as machining, lapping, grinding and etc.

In order to provide the finished contact material, it has been found in practicing the method of the present invention, that the second metal having the higher melting point than that of the first metal occupy between about 30 percent and about 70 percent by volume of the finished cast configuration. Therefore, on a weight basis the components must be adjusted so that by volume in the finished product the second metal will occupy between about 30 percent and about 70 percent by volume of the contact material final configuration. It is believed that the volume of the second metal within these limits must be observed in order for the entire contact material to function having a better current interruption capability and thereby provide the proper chopping level when the contact material is operated in a vacuum environment.

It has been found that by utilizing the process of the present invention, one of the serious drawbacks present in the production of contact material involving a sintered skeletal matrix of a refractory metal into which copper base alloys are infiltrated has been eliminated. Heretofore, it has been found that when a sintered skeletal matrix of a refractory metal is infiltrated with copper, the interstices between the adjacent grains may be of such a physical dimension that voids occur with the result that hot spots develop as well as uneven erosion during normal operation. This results in premature failure and unsatisfactory performance of the contact materials.

Moreover, because of the limited size restriction of the skeletal matrix, only a very narrow range of composition could be successfully employed in the infiltrated matrix. In contrast thereto, applicant's process provides for a wide range of compositions to be utilized and consequently the current interruption ability can suitably be tailored to a predetermined range of operation because of the wide range of composition which is available employing the applicant's novel process. By employing such a wide range of compositions, not only can the current chopping level be adjusted but also the weld strength of the material can be tailored to suit the mechanical conditions which are anticipated when the material is used as a contact material in a vacuum interrupter.

It has been found heretofore that when high power testing interrupters made by the prior art techniques, the interruption performance appears to improve with high power testing. It appears that the contact surfaces of the contact material become altered due to excessive arcing and melting when the interrupter passes several current zeros before interruption. While the melting and alteration of the prior art metallic structure does not appear to degrade the interruption performance, it would appear that it in fact enhances such a performance. Thus, it has been common in utilizing contact materials in vacuum interrupters to subject the same to a predetermined aging prior to shipment and embodiment in an actual current interruption circuit.

In contrast thereto, by employing the technique of the applicant's process, such high power testing power testing does not appear to markedly change the interrupters performance and thus eliminates such aging as has been necessary heretofore when the contact materials are produced by the prior art method.

In another embodiment of the present invention, predetermined amounts of the first and second metals may be blended in a known manner. For example, +to 70% by volume of chromium powder may be blended with copper powder in a powder metal blender. To this mixture may be added up to 1% by weight of zirconium for its gettering effect. This mixture may then be formed into a predetermined configuration and the configuration is then subjected to a vacuum environment along with a non consumable electrode which when energized is capable of melting at least the metal of the lower melting point of the blended mixture. If the preferred blended powder is confined within a mold, the blended powders may be melted and/or remelted a number of times to obtain the desired configuration of the contact material which will have a uniform consistency and composition. From the foregoing it appears that the method of the applicant's process as described hereinbefore has made a substantial advance in the art by eliminating costly high powered aging treatments to heretofore form contact materials. In contrast thereto, a wide variety of compositions are available when employing the applicant's process and such compositions can be tailored to suit the particular idiosyncrasies of the intended use of the material in a vacuum interrupter.

I claim:

1. In a method of making contact materials suitable for use in a vacuum interrupter, the steps comprising melting a predetermined mass of a first metal having a high electrical conductivity, adding from about 30% to about 70% of a second metal in solid form to said molten mass, said second metal having:

a. a melting point in excess of the melting point of the first metal, and b. a solid solubility in the first metal of less than 1 percent by weight at the temperature to which the first metal is heated, the temperature to which the first metal is heated being within the range between the melting point of the first metal and below the melting point of the second metal, intermixing the liquid and solid components to a uniform consistency, casting the component into the desired configuration, and cooling said configuration to room temperature.

2. The method of claim 1 in which up to 1 percent of a gettering material is intermixed with the second metal prior to adding the second metal to the molten mass.

3. The method of claim 1 in which the second metal is chromium.

4. The method of claim 1 in which the first metal is copper.

5. The method of claim 1 in which the first metal is copper, the second metal is chromium and zirconium is added to the chromium in an amount of up to 0.5 percent by weight of the chromium percent.

6. In a method of making contact materials suitable for use in a vacuum interrupter, the steps comprising melting a predetermined mass of a first metal having a high electrical conductivity and selected from the group consisting of copper, copper base alloys, silver and silver base alloys, adding a predetermined amount of a second metal to said molten mass said second metal being selected from the group consisting of chromium, vanadium, beryllium and manganese, intermixing the solid and liquid components to a uniform consistency casting the components into the desired configuration, and cooling said configuration to room temperature.

7. The method of claim 6 in which up to 1 percent by weight of zirconium is intermixed with the second metal prior to adding the second metal to the molten mass.

8. In the method making contact materials suitable for use in a vaccum interrupter, the steps comprising blending to a uniform consistency and composition a mass of a first metal having a high electrical conductivity with from about 30% to about 70% by volume of a second metal having a. a melting point in excess of the melting point of the first metal; and, b. a solid solubility in the first metal of less than 1% by weight at the melting point temperature of the first metal, forming the blended metals to the desired configuration, heating the configuration to a temperature sufficiently high to cause at least the first metal to melt and thereafter cooling the configuration to room temperature.

* * * * *